US006857578B2

(12) United States Patent
Alvarez et al.

(10) Patent No.: US 6,857,578 B2
(45) Date of Patent: Feb. 22, 2005

(54) COMBINATION WATER HEATING AND SPACE HEATING APPARATUS AND CONTROL THEREFOR

(75) Inventors: Robert J. Alvarez, Carrollton, TX (US); Gregory W. Murtha, Marshalltown, IA (US); Islam O. Shahin, Dallas, TX (US)

(73) Assignee: Lennox Manufacturing Inc., Richardson, TX (US)

( * ) Notice: Subject to any disclaimer, the term of this patent is extended or adjusted under 35 U.S.C. 154(b) by 0 days.

(21) Appl. No.: 10/439,251

(22) Filed: May 15, 2003

(65) Prior Publication Data

US 2004/0227003 A1 Nov. 18, 2004

(51) Int. Cl.[7] ..... F24H 3/06

(52) U.S. Cl. ..... 237/7; 237/19; 237/16; 237/2 A

(58) Field of Search ..... 237/7, 19, 2 A; 126/101, 116 A

(56) References Cited

U.S. PATENT DOCUMENTS 4,371,111 A 2/1983 Pernosky
4,541,410 A 9/1985 Jatana
4,584,987 A 4/1986 Rotili
4,641,631 A 2/1987 Jatana
4,700,888 A * 10/1987 Samulak ..... 237/2 A
4,766,883 A 8/1988 Cameron et al.
5,544,645 A 8/1996 Armijo et al.
6,332,580 B1 * 12/2001 Enander et al. ..... 237/2 A

* cited by examiner

*Primary Examiner*—Derek S. Boles
(74) *Attorney, Agent, or Firm*—W. Kirk McCord

(57) ABSTRACT

A combination water heating and space heating apparatus includes a water heating unit and a space heating unit. The water heating unit has a water storage tank, a heating device for heating water stored in the tank, and a first temperature sensor for sensing water temperature. The space heating unit includes a heat exchanger for heating air supplied to an indoor space, a blower for blowing air over the heat exchanger, and a second temperature sensor for sensing air temperature in the space. Heated water is supplied from the tank to the heat exchanger by means of a circulation pump when the second temperature sensor indicates a demand for heat in the space. The apparatus is controlled to give priority to domestic hot water use (e.g., potable water) over space heating use. This is accomplished by disabling the blower in response to the temperature of the heated water supplied from the tank to the heat exchanger being below a predetermined temperature, while still allowing heated water to be circulated between the tank and the heat exchanger as long as a demand for space heating is still present. When the temperature of the heated water supplied to the heat exchanger recovers above the predetermined temperature, the blower is re-enabled to blow air over the heat exchanger if the demand for space heating is still present.

9 Claims, 3 Drawing Sheets

COMBINATION WATER HEATING AND SPACE HEATING APPARATUS AND CONTROL THEREFOR

TECHNICAL FIELD

This invention relates generally to heating apparatus and in particular to combination water heating and space heating apparatus.

BACKGROUND ART

Combination water heating and space heating systems, wherein hot water is used for both domestic and space heating purposes, are known in the art. See for example, the combination systems described and shown in U.S. Pat. Nos. 4,371,111; 4,541,410; 4,584,987; 4,641,631; 4,766,883; and 5,544,645. In such combination systems, in response to a demand for heating in an indoor space, heated water is circulated between a hot water storage tank and a hydronic heat exchanger coil located in an air supply duct, to heat air passing over the coil, thereby providing heated air to the space. Heated water in the tank is also used to satisfy a demand for domestic hot water (e.g., showers, laundry, dishwasher, etc.).

If there is a concomitant demand for space heating and for domestic hot water, the hot water supply in the tank may be insufficient to satisfy both demands. Accordingly, priority must be given to either the space heating demand or the domestic hot water demand.

U.S. Pat. No. 4,584,987 teaches a fireplace boiler system for heating water, primarily for space heating use. The hot water is available for domestic use only after a space heating demand is satisfied. Therefore, hot water is not available for domestic use at the same time that there is a demand for space heating.

U.S. Pat. No. 5,544,645 discloses a combination water heating and space heating apparatus in which priority is given to a demand for domestic hot water in the event of a low temperature condition in the hot water storage tank. The control system tries to prevent this problem by anticipating the increased demand for hot water by raising the setpoint of the hot water storage tank in response to a demand for space heating.

SUMMARY OF THE INVENTION

Combination water heating and space heating apparatus includes a water heating unit and a space heating unit. The water heating unit has a water storage tank, a heating device for heating water stored in the tank, and a first sensor for sensing temperature of water stored in the tank. The space heating unit includes an air duct for supplying air to an indoor space, a heat exchanger for heating air supplied to the space, an air mover for moving air over the heat exchanger, and a second sensor for sensing temperature of air in the space. A water circulating device is provided for circulating water between the tank and the heat exchanger.

The apparatus further includes a control device adapted to control the heating device to heat the water in the tank in response to the first sensor sensing a water temperature in the tank that is below a predetermined first temperature, which corresponds to a demand for water heating in the tank. The control device is further adapted to control the water circulating device to supply heated water from the tank to the heat exchanger and the air mover to move air over the heat exchanger in response to the second sensor sensing an air temperature in the space that is below a predetermined second temperature, which corresponds to a demand for space heating, whereby air to be supplied to the indoor space is heated. In accordance with the present invention, the control device is operable to disable the air mover in response to a predetermined water temperature condition, even when there is a demand for space heating.

In accordance with one aspect of the invention, the control device is operable to disable the air mover in response to the predetermined water temperature condition without disabling the water circulating device when there is a demand for space heating. In accordance with another aspect of the invention, the control device is operable to re-enable the air mover to move air over the heat exchanger in response to a demand for space heating, when the predetermined water temperature condition is no longer present.

In accordance with yet another aspect of the invention, the control device includes a third sensor external to the water storage tank for sensing temperature of the heated water supplied by the water circulating device from the tank to the heat exchanger in response to a demand for space heating and for disabling the air mover in response to the temperature of the heated water supplied by the water circulating device being below a predetermined third temperature, even when there is a demand for space heating. In one embodiment, the third sensor is located to sense temperature of the heated water in a conduit through which the heated water is supplied from the tank to the heat exchanger.

In accordance with a preferred embodiment of the invention, the air mover is an electrically operable blower and the third sensor is a thermostat having a setpoint corresponding to the predetermined third temperature. The thermostat is operable to inhibit electrical power from being supplied to the blower in response to the temperature of the heated water supplied by the water circulating device being below the thermostat setpoint. The thermostat is preferably located to sense temperature of the heated water in a conduit through which heated water is supplied from the tank to the heat exchanger by the water circulating device.

In accordance with the present invention, priority is given to using the heated water for domestic use over space heating use. If the temperature of the heated water supplied to the heat exchanger drops below a predetermined temperature when there is a demand for space heating, the control will disable the air mover from moving air across the heat exchanger, but will allow the water circulating device to continue to circulate water between the heat exchanger and the tank. When the temperature of the heated water supplied to the heat exchanger recovers above the predetermined temperature, the air mover is re-enabled to move air across the heat exchanger, provided that a demand for space heating is still present.

BEST MODE FOR CARRYING OUT THE INVENTION

The best mode for carrying out the invention will now be described with reference to the accompanying drawings.

Like parts are marked in the specification and drawings with the same respective reference numbers. In some instances, proportions may have been exaggerated in order to depict certain features of the invention.

Figure 1:
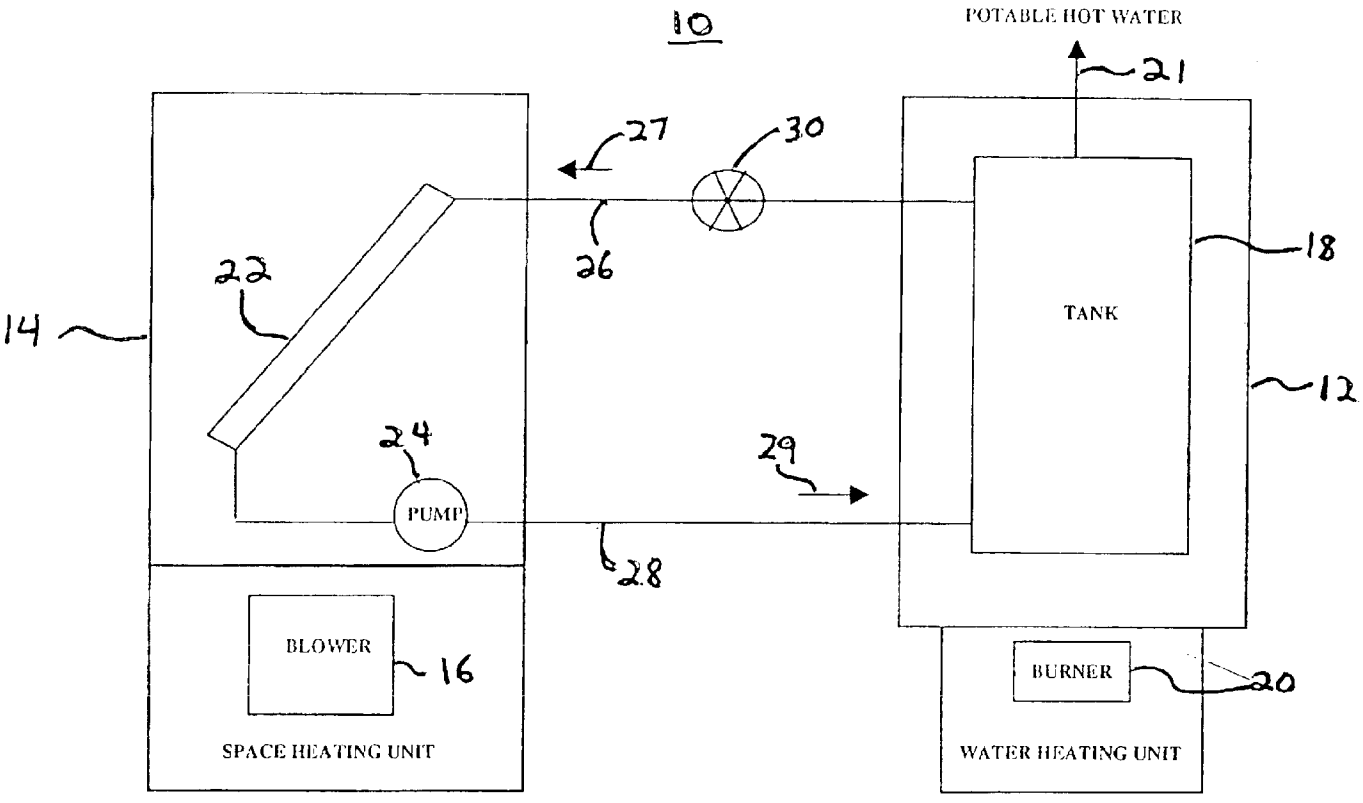
FIG. 1 is a schematic of a combination water heating and space heating apparatus, according to the present invention.

Referring now to FIG. 1, a combination water heating and space heating apparatus 10 includes a water heating unit 12 and a space heating unit 14. In FIG. 1, space heating unit 14 is depicted in a position for "up flow" operation (i.e., air is blown upwardly through unit 14 by a blower 16). Although not shown in the drawings, one skilled in the art will recognize that alternatively unit 14 may be positioned for "down flow" (i.e., air is blown downwardly through unit 14) or "side flow" (i.e., unit 14 is positioned horizontally for horizontal air flow) operation.

Water heating unit 12 includes a water storage tank 18 and a burner 20 proximate to tank 18 for heating water stored in tank 18. Burner 20 is preferably a conventional gas burner. Water heating unit 12 is used to supply water for space heating purposes to space heating unit 14 and to supply potable water for domestic use via a conduit 21.

Space heating unit 14 includes a heat exchanger coil 22, which is preferably a conventional hydronic coil with a plurality of tubes (not shown) and fins (not shown) between the tubes. Unit 14 also includes a water circulation pump 24 for drawing heated water from tank 18 through coil 22 via a supply conduit 26. The direction of flow of the heated water in supply conduit 26 is indicated by arrow 27. The heated water makes multiple passes through coil 22 and is returned to tank 18 via a return conduit 28. The direction of flow of water in return conduit 28 is indicated by arrow 29. Air to be supplied to an indoor space (not shown) is blown by blower 16 across the outside of coil 22 in heat exchange relationship with the heated water inside coil 22, whereby heat is transferred from the water inside the tubes of coil 22 to the air passing over the outside of coil 22.

A thermostat 30 is located in supply conduit 26 for measuring the temperature of the heated water supplied to coil 22. Thermostat 30 is preferably a thermostat of the "well immersion" type. When the temperature of the heated water in supply line 26 falls below a predetermined setpoint (e.g., 135° F.) by a predetermined amount (e.g., by 7° F. or more), thermostat 30 disables blower 16 until the temperature of the water in supply line 26 recovers to the setpoint. Therefore, thermostat 30 functions as a priority thermostat to give priority to a domestic hot water demand over a space heating demand when water heating unit 12 is unable to effectively satisfy both demands.

Figure 2:
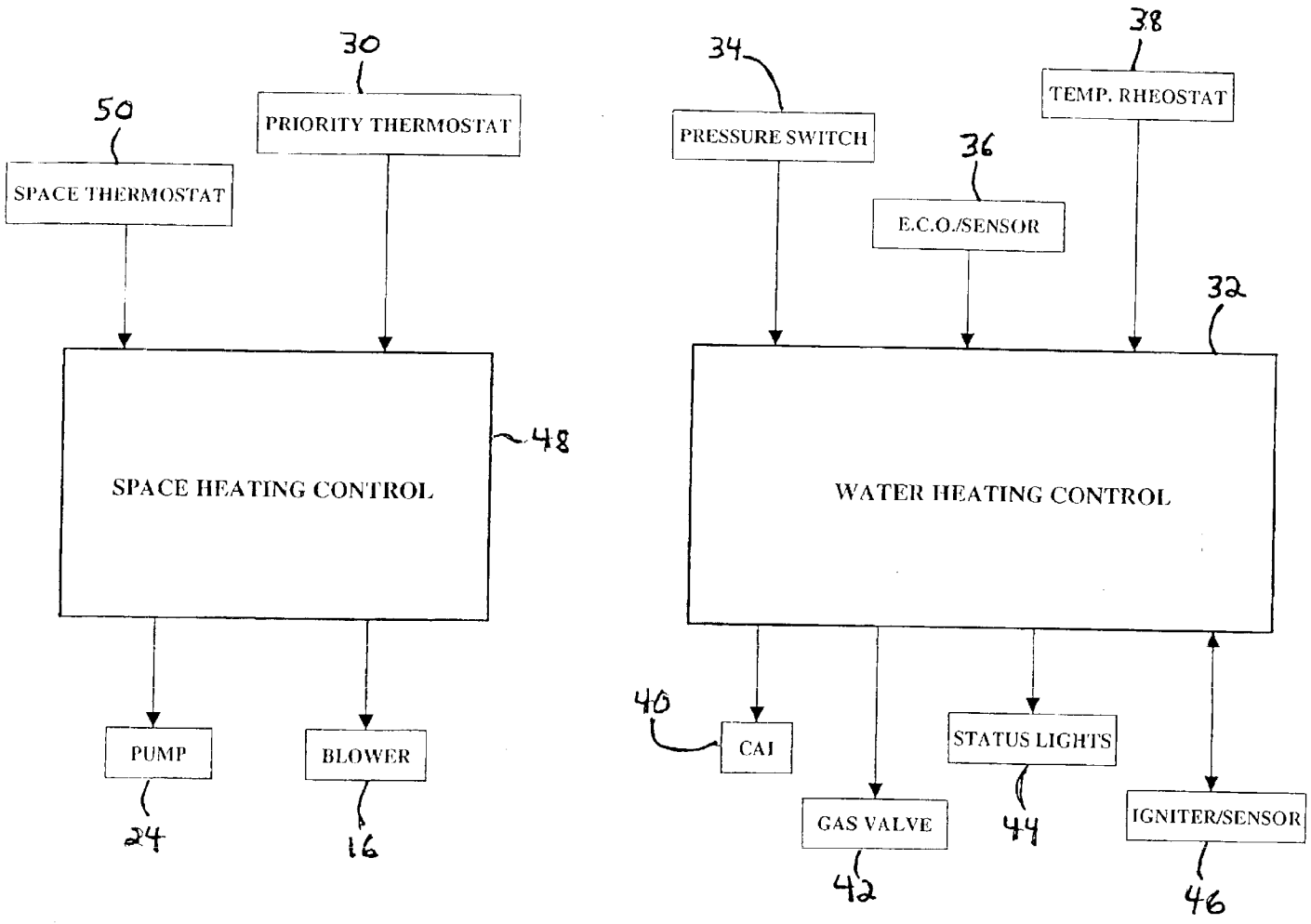
FIG. 2 is a block diagram of an electronic control system for the apparatus of FIG. 1.

Referring also to FIG. 2, water heating unit 12 includes a water heating control module 32. Control module 32 receives inputs from various sensors, including a pressure switch 34, an energy cutoff (ECO)/temperature sensor 36 and a temperature rheostat 38, and uses these inputs to control various components such as a combustion air inducer (CAI) 40, a gas valve 42, status lights 44 and an igniter/flame sensor 46 in a conventional manner. Pressure switch 34 measures the differential pressure across an orifice (not shown) or other restrictor in a combustion air supply line (not shown) to burner 20. Rheostat 38 is manually operable to set the desired temperature of the water in tank 18. ECO/Sensor 36 performs two functions. It closes gas valve 42 to inhibit further heating of the water in tank 18 when the temperature of the water in tank 18 has reached the setpoint (e.g., 130° F.) of rheostat 38. Further, ECO/Sensor 36 functions as a high temperature cutoff switch to shut down water heating unit 12 when the water temperature in tank 18 exceeds a high temperature limit (e.g., 190–200° F.).

Figure 3:
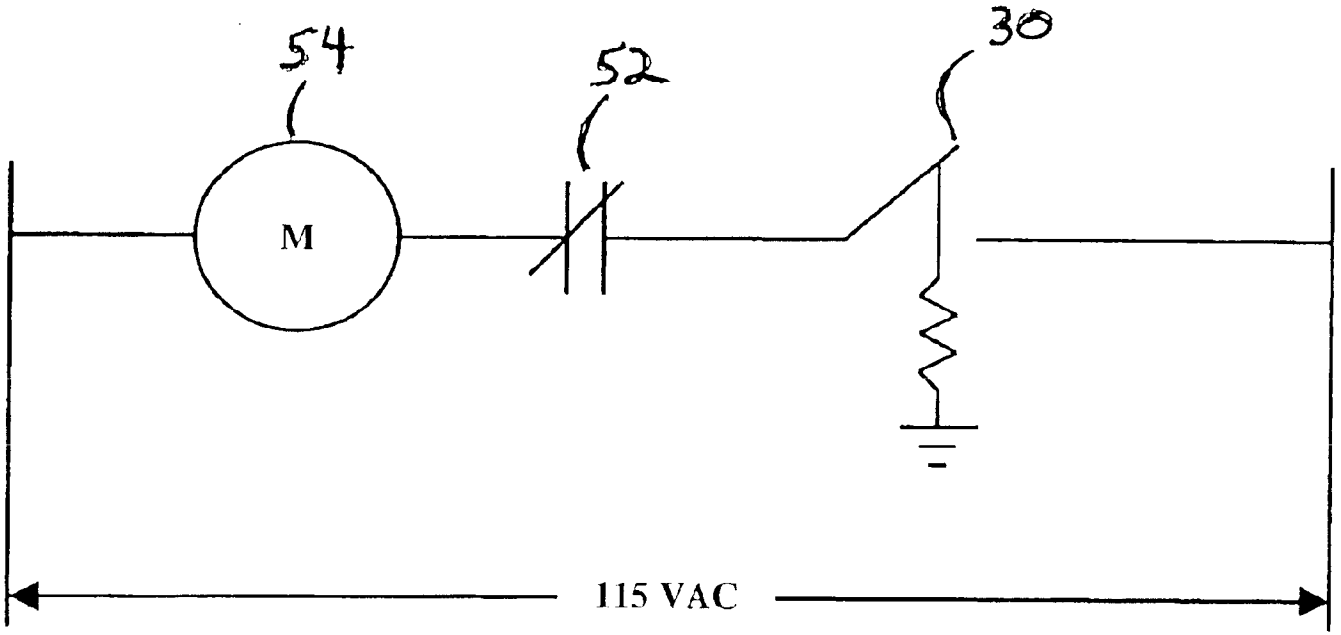
FIG. 3 is an electrical circuit diagram of a hot water priority control device for the apparatus of FIG. 1, according to the present invention.

Space heating unit 14 includes a space heating control module 48. Control module 48 receives inputs from a thermostat 50, which indicates a demand for heating in an indoor space when the temperature in the space drops below the setpoint of thermostat 50. Referring also to FIG. 3, a demand for space heating signal from thermostat 50 closes a relay 52 in control module 48, which causes control module 48 to activate both circulation pump 24 and blower 16.

As can be best seen in FIG. 3, priority thermostat 30 functions as a temperature activated switch in series with relay 52. Switch 30 is normally in a closed position so that when relay 52 is closed in response to a demand for space heating, 115 VAC electrical power is supplied to blower motor 54, which activates blower 16. Switch 30 is shown in an open position in FIG. 3. Switch 30 is in the open position when the water temperature in supply line 26 falls below the setpoint of thermostat 30 by a predetermined amount, which indicates that water heating unit 12 is unable to satisfy both the space heating and domestic hot water demands. When this condition occurs, priority is given to the domestic hot water demand and switch 30 is opened to interrupt the electrical power supply to blower motor 54. Even if thermostat 50 is set for "continuous fan" operation, thermostat 30 will override this setting and not allow blower 16 to be operated as long as the temperature of the heated water in supply conduit 26 is below the predetermined threshold.

Even when blower 16 is disabled by priority thermostat 30, pump 24 will continue to circulate water between coil 22 and tank 18 in response to a demand for space heating. It is advantageous to continue to circulate water between coil 22 and tank 18, even when blower 16 is disabled, so that thermostat 30 can continue to monitor the temperature of the heated water in supply conduit 26 to determine when the temperature has recovered to the setpoint of thermostat 30, which indicates that blower 16 can be activated in response to a demand for space heating.

The best mode for carrying out the invention has now been described in detail. Since changes in and additions to the above-described best mode can be made without departing from the nature, spirit and scope of the invention, the invention is not to be limited to the above-described best mode, but only by the appended claims and their equivalents.

What is claimed is:

1. In a combination water heating and space heating system having a water heating unit for providing heated water for potable water use and for space heating use, a space heating unit for providing heated air to an indoor space, and a water circulating device for circulating water between the water heating unit and the space heating unit, the space heating unit including a heat exchanger for heating air supplied to the space and an air mover for moving air over the heat exchanger, a method of controlling operation of the system to give priority to providing heated water for potable water use over space heating use in response to a predetermined water temperature condition, said method comprising the steps of:

controlling the water circulating device to supply heated water from the water heating unit to the heat exchanger in response to a demand for heating in the space;

determining whether said predetermined water temperature condition is present;

selectively enabling the air mover to move air over the heat exchanger in response to said demand for heating when said predetermined water temperature condition is not present or, alternatively, disabling the air mover when said predetermined water temperature condition is present; and allowing the water circulating device to supply heated water to the heat exchanger in response to said demand for heating, irrespective of whether said predetermined water temperature condition is present, whereby priority is given to providing heated water for potable water use over space heating use when said predetermined water temperature condition is present without interrupting the supply of heated water to the heat exchanger in response to said demand for heating.

2. The method of claim 1 wherein the air mover is operable in a continuous mode, whereby the air mover is enabled to move air continuously over the heat exchanger, irrespective of whether said demand for heating is present, said method further including overriding the continuous fan mode to disable the air mover when said predetermined water temperature condition is present.

3. The method of claim 1 wherein the water heating unit includes a water storage tank and the system includes a conduit between the tank and the heat exchanger through which heated water is supplied to the heat exchanger in response to said demand for heating, said determining including monitoring the temperature of the heated water in said conduit when the water circulating device supplies heated water to the heat exchanger in response to said demand for heating, said predetermined water temperature condition corresponding to the temperature of the heated water in the conduit being less than a predetermined temperature.

4. The method of claim 3 wherein said determining includes continually monitoring the temperature of the heated water in said conduit whenever said demand for heating is present and said disabling includes inhibiting operation of said air mover whenever the temperature of the heated water in the conduit is less than said predetermined temperature.

5. In a combination water heating and space heating system having a water heating unit for providing heated water for potable water use and for space heating use, a space heating unit for providing heated air to an indoor space, and a water circulating device for circulating water between said water heating unit and said space heating unit, said space heating unit including a heat exchanger for heating air supplied to the space and an air mover for moving air over said heat exchanger, wherein the improvement comprises control apparatus operable to control said water circulating device to supply heated water from said water heating unit to said heat exchanger and to enable said air mover to move air over said heat exchanger in response to both a demand for heating in the space and the absence of a predetermined water temperature condition, said control apparatus being further operable to disable said air mover when said predetermined water temperature condition is present without disabling said water circulating device from supplying heated water to said heat exchanger when said demand for heating is present, whereby priority is given to providing heated water for potable water use over space heating use when said predetermined water temperature condition is present.

6. The system of claim 5 wherein said air mover is operable in a continuous mode, whereby said air mover is enabled to move air continuously over said heat exchanger, irrespective of whether said demand for heating is present, said control apparatus being operable to override said continuous mode to disable said air mover when said predetermined water temperature condition is present.

7. The system of claim 5 further including a water storage tank and a conduit between said tank and said heat exchanger through which heated water is supplied to said heat exchanger in response to said demand for heating, said control apparatus further including a temperature sensor located to sense temperature of the heated water in said conduit when said water circulating device supplies heated water to said heat exchanger in response to said demand for heating, said predetermined water temperature condition corresponding to the temperature of the heated water in the conduit sensed by said temperature sensor being below a predetermined temperature.

8. The system of claim 5 further including a water storage tank and a conduit between said tank and said heat exchanger through which heated water is supplied to said heat exchanger in response to said demand for heating, said control apparatus further including a thermostat having a setpoint, said thermostat being located to sense temperature of the heated water in said conduit when said water circulating device supplies heated water to said heat exchanger in response to said demand for heating, said predetermined water temperature condition corresponding to the temperature of the heated water in the conduit sensed by said thermostat being below said setpoint.

9. The system of claim 8 wherein said thermostat is operable to inhibit electrical power from being supplied to said air mover in response to the temperature of the heated water in said conduit sensed by said thermostat being below said setpoint.

* * * * *